US008696291B2

(12) United States Patent
Haney et al.

(10) Patent No.: US 8,696,291 B2
(45) Date of Patent: Apr. 15, 2014

(54) SPAR HULL LOAD OUT METHOD

(75) Inventors: James Allan Haney, Houston, TX (US); Bee-Lay Leow, Katy, TX (US)

(73) Assignee: J. Ray McDermott, S.A., Houston, TX (US)

( * ) Notice: Subject to any disclaimer, the term of this patent is extended or adjusted under 35 U.S.C. 154(b) by 223 days.

(21) Appl. No.: 13/313,185

(22) Filed: Dec. 7, 2011

(65) Prior Publication Data

US 2012/0148381 A1 Jun. 14, 2012

Related U.S. Application Data

(60) Provisional application No. 61/422,712, filed on Dec. 14, 2010.

(51) Int. Cl.

| | |
|---|---|
| ***B63B 27/00*** | (2006.01) |
| ***B63B 35/00*** | (2006.01) |
| ***B65G 67/60*** | (2006.01) |

(52) U.S. Cl.

USPC ..... 414/141.9; 414/139.8; 414/140.6; 405/200; 114/125

(58) Field of Classification Search

USPC ..... 414/141.9, 139.4, 139.8, 139.9, 140.6, 414/758

See application file for complete search history.

(56) References Cited

U.S. PATENT DOCUMENTS

| | | | | |
|---|---|---|---|---|
| 3,680,512 | A * | 8/1972 | Yamura | 114/46 |
| 4,135,842 | A * | 1/1979 | Blight et al. | 405/209 |
| 6,244,785 | B1 * | 6/2001 | Richter et al. | 405/195.1 |
| 6,565,286 | B2 * | 5/2003 | Carr et al. | 405/204 |
| 6,672,803 | B2 * | 1/2004 | Richter et al. | 405/195.1 |
| 6,953,308 | B1 * | 10/2005 | Horton | 405/211 |
| 7,553,106 | B2 * | 6/2009 | Horton et al. | 405/195.1 |
| 2008/0014024 | A1 * | 1/2008 | Lokken et al. | 405/195.1 |
| 2010/0192829 | A1 * | 8/2010 | Luo et al. | 114/285 |
| 2010/0221070 | A1 * | 9/2010 | Luo et al. | 405/204 |

* cited by examiner

*Primary Examiner* — Gregory Adams
*Assistant Examiner* — Lynn Schwenning
(74) *Attorney, Agent, or Firm* — D. Neil LaHaye

(57) ABSTRACT

A load out and float off method for a spar type structure or another structure such as a deck. The invention enables the load out and float off of a large diameter spar using existing Heavy Lift Vessels (HLV's). A U-shaped tank (U-tank) is utilized to artificially extend the length of the HLV and provide supplemental buoyancy to help lift the spar off the land ways. The U-tank provides supplemental buoyancy and water plane area to float the spar off the HLV. After HLV departure the U-tank is moved and placed beneath an adapter frame on the spar's hard tank. The U-tank is ballasted upward to reduce the hard tank draft and have the strake tips clear the channel bottom. The spar can then be brought alongside the fabrication yard quay for additional work and then towed down the channel to the open sea.

8 Claims, 7 Drawing Sheets

SPAR HULL LOAD OUT METHOD

PRIORITY CLAIM

This application claims priority from Provisional Application No. 61/422,712 filed Dec. 14, 2010.

FIELD AND BACKGROUND OF INVENTION

The invention is generally related to floating offshore structures and more particularly to the load out, float off, and channel tow of a spar type hull.

There are a number of spar hull designs available in the offshore drilling and production industry. These include the truss spar, classic spar, and cell spar. The term spar hull structure described herein refers to any floating structure platform, which those of ordinary skill in the offshore industry will understand as any floating production and/or drilling platform or vessel having an open centerwell configuration.

The spar supports a topside structure and comprises a hard tank, truss section, and a soft tank. In the case of the classic spar, the hard tank and soft tank are connected by a cylinder instead of a truss. The hard tank supplies the majority of the buoyancy to support the hull structure, risers, and topsides. The hard tank is divided into a number of chambers among which the ballast water can be shifted to control the spar's buoyancy and stability.

When the spar is placed in its operating configuration offshore, the spar cylinder is exposed to currents in the ocean. The current acting on the spar cylinder produces VIV (vortex induced vibration). Because the VIV can produce unacceptable motions of the spar, helical strakes are added to the cylindrical portion of the spar as a means of eliminating or reducing the VIV. The strakes extend outwardly from the hard tank and are attached in a helical pattern around the hard tank. The fact that helical strakes reduce VIV is well known in the offshore industry.

The hard tanks of a spar can be as much as 150 feet in diameter. To be effective the strakes must extend outward from the hull a distance of 12-15% of the hull diameter. The strakes add significantly to the outside diameter of the hard tank without adding much buoyancy. Spars are built lying on their sides, loaded out onto HLV's (Heavy Lift Vessels) on their sides, and floated off into the water on their sides. Therefore, on the larger diameter spars there is not sufficient water depth near the fabrication yard to provide bottom clearance for the strake tips. Since the float off operation is very sensitive to sea states, the spars must be floated off the HLV in protected water near the fabrication yard.

When the HLV is ballasted downward to float off the spar, the HLV with the spar on board goes through a minimal stability when the deck of the HLV goes awash. This occurs because the HLV loses most of its water plane area when its deck goes awash, and the spar is not yet picking up much water plane area. Traditionally, the problem has been solved with two methods. First, the HLV is trimmed by the stern so that the soft tank of the spar picks up some water plane area, before the HLV deck goes awash. Second, supplementary stability modules are added to the HLV deck to improve stability.

Frequently, after the spar is floated off the HLV in protected water the spar must be moved alongside the fabrication yard quay to perform additional work. Once the spar is completed it must be towed down the channel to the open sea. However, there is insufficient water depth at quayside to provide strake tip clearance, and there is insufficient strake tip bottom clearance in the channel leading from the fabrication yard to the open sea.

One method of solving the clearance problem is to install a portion of the strakes at sea. That way, the strakes do not project below the "belly" of the hard tank during the movement of the spar to quayside, or during the channel tow. This method has been tried once, and was found to be more difficult and expensive than expected.

The weight and vertical center of gravity of a large diameter spar are too great for load out and float off by existing HLV's. The solution has been to build the spar in two pieces, then load out and transport each piece separately, float off the individual pieces, and then join them as they float on their sides in protected water. However, this adds expense and difficulty to the construction of the spar and is not a favored solution.

Thus, it can be seen that there is a need for an improved method for load out and transport to the open sea of a spar type structure.

SUMMARY OF INVENTION

The present invention addresses the shortcomings in the known art and is drawn to a method and apparatus that yields sufficient bottom clearance for the strake tips of a large diameter spar. In addition, the present invention makes it possible to load out and float off a large diameter spar in one piece using existing HLV's. The present invention also applies to the load out of other structures such as a deck.

A U-tank is placed between the stern of the HLV and the fabrication yard quay. The U-tank is equipped with load out ways. During load out the spar skids along the U-tank ways onto the HLV. The spar ends up partly on the HLV and partly on the U-tank. The U-tank artificially extends the length of the HLV and provides supplemental buoyancy and water plane area that enables existing HLV's to lift the spar off the fabrication yard ways during load out.

After load out onto the HLV and U-tank, the spar assembly is moved to a float off site nearby. The site must have sufficient water depth for a float off. Most float off sites near a fabrication yard in protected water would require that a pit be dredged to provide the required water depth. The HLV will be ballasted downward to float the spar off the HLV. The U-tank provides enough supplemental buoyancy and water plane area to enable the float off.

After the departure of the HLV and while the spar is still at the float off site, the U-tank is relocated and placed beneath a frame that cantilevers from the top end of the hard tank. The U-tank is ballasted upward to lift the spar. Lifting the spar reduces its draft and provides the strake tip bottom clearance required to move the spar alongside the fabrication yard quay, and subsequently, for the channel tow.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

The invention is a sequence of positions and operations of the U-tank acting in concert with the HLV.

Figure 1:
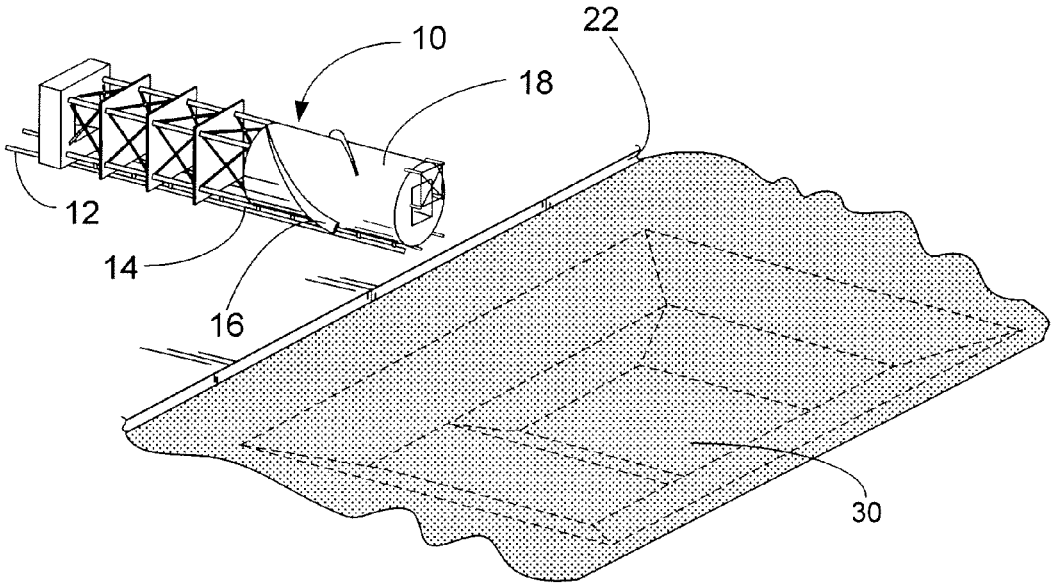
FIG. 1 is a perspective view of a spar lying on its side in a fabrication yard.

As seen in FIG. 1, a spar 10 is shown on the ways 12 ready for load out and perpendicular to the quay 22. The spar 10 is built on a cradle structure (not shown because it is obscured by the spar 10 in this view) that extends most of the length of the spar 10. Two parallel load out runners 14 are framed into the cradle. These runners 14 rest directly on the load out ways 12. Both the spar 10 and its cradle are loaded out together, the cradle runners 14 sliding along the load out ways 12.

The strakes 16 are shown as being incomplete on the bottom side of the hard tank 18. It should be understood that "incomplete", in the offshore industry, may mean that the strakes on the bottom side of the hard tank are partial strakes that extend outward from the hard tank 18 only a portion of the specified distance as indicated above and the remainder of the strake will be installed after the spar 10 is in the water. It can also mean that no strakes are attached to the bottom of the hard tank 18 while it is on land and that this portion of the strakes will be attached after the spar 10 is in the water.

Figure 2:
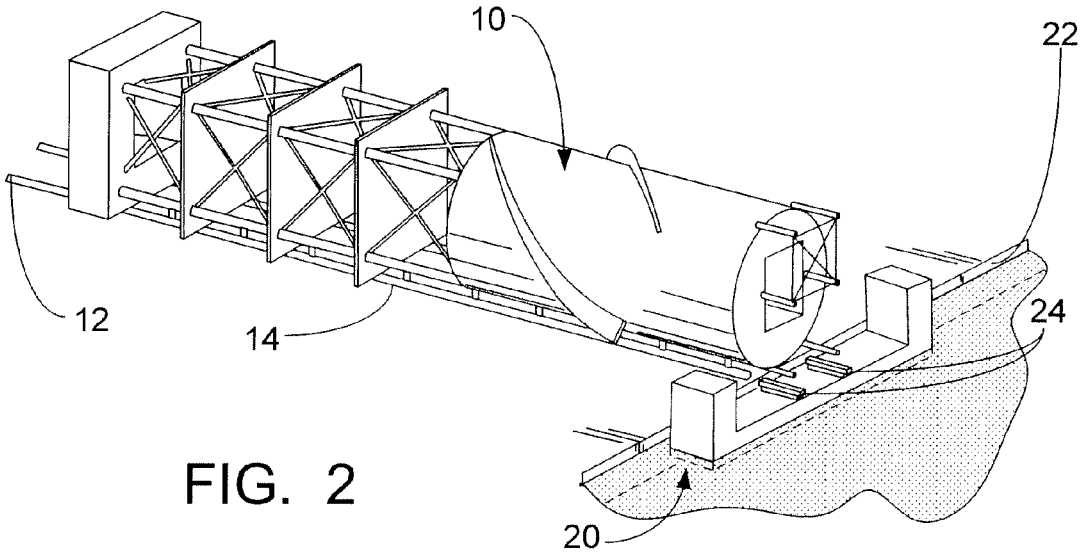
FIG. 2 is a perspective view that shows the U-tank alongside the quay.

As seen in FIG. 2, a purpose-built U-tank 20 (U-shaped tank) is moored alongside the quay 22. The U-tank 20 has skid beams 24 that allow the skidding of the spar 10 over the U-tank 20. The U-tank is shown with stability columns at each end and it must be compartmented and outfitted with a power supply and a ballast system. To give a notion of scale, for a large diameter spar the U-tank would have to be roughly 350 feet long×50 feet wide with 65 foot high stability columns on each end, and a net buoyancy force of 10,000 short tons.

Figure 3:
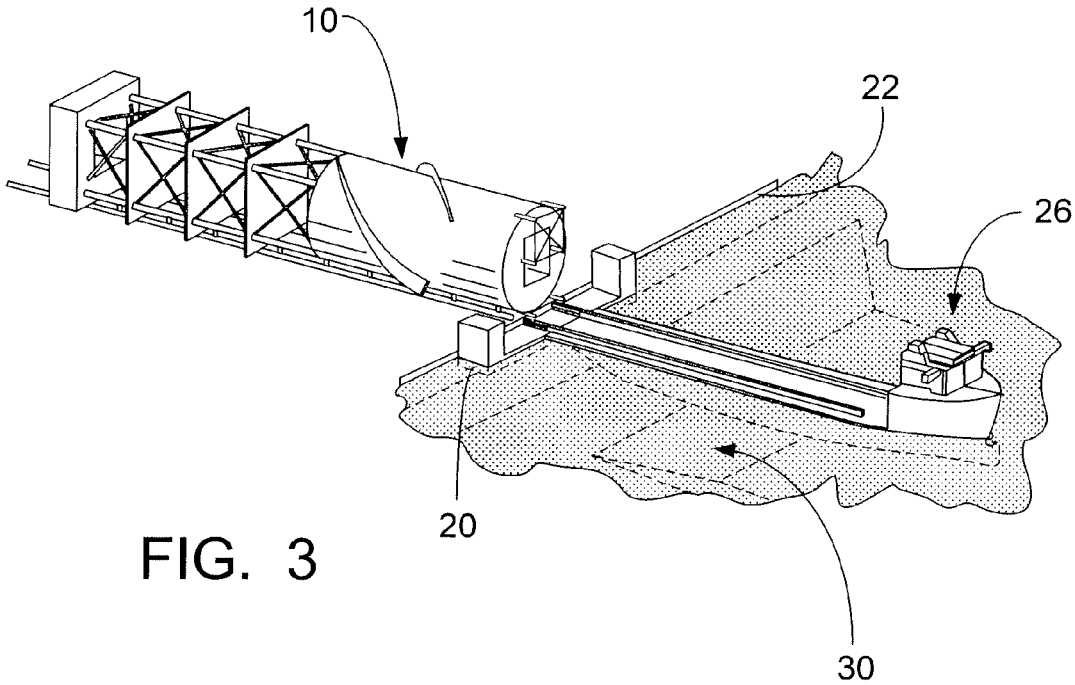
FIG. 3 is a perspective view of the spar, U-tank, and HLV ready for load out.

As seen in FIG. 3, the HLV 26 is moored with its stern against the U-tank 20. The HLV 26 by itself does not have sufficient buoyant force or global hogging strength to lift the spar 10 off the fabrication yard ways 12 during the load out. The stability columns normally present on the HLV 26 have been removed to allow the spar 10 to load out on the centerline of the HLV 26.

Figure 4:
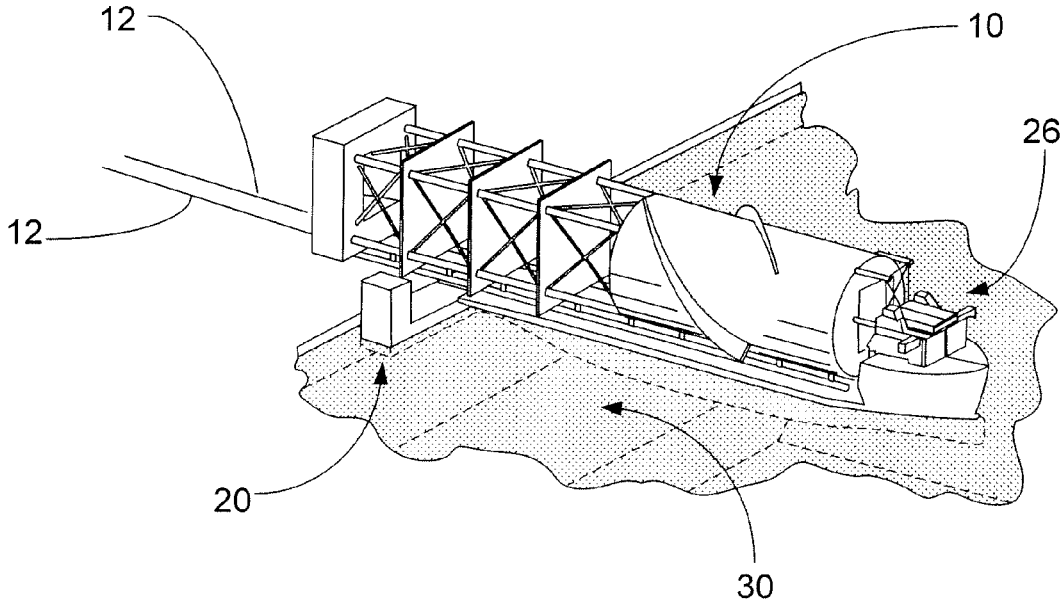
FIG. 4 is a perspective view of the spar, U-tank, and HLV at the completion of load out.

As seen in FIG. 4, the spar 10 has been loaded out over the U-tank 20 onto the HLV 26. During the load out the U-tank 20 and the HLV 26 are ballasted in concert to keep the assembly stable and prevent structural overload of the HLV 26 during all stages of the load out.

Figure 5:
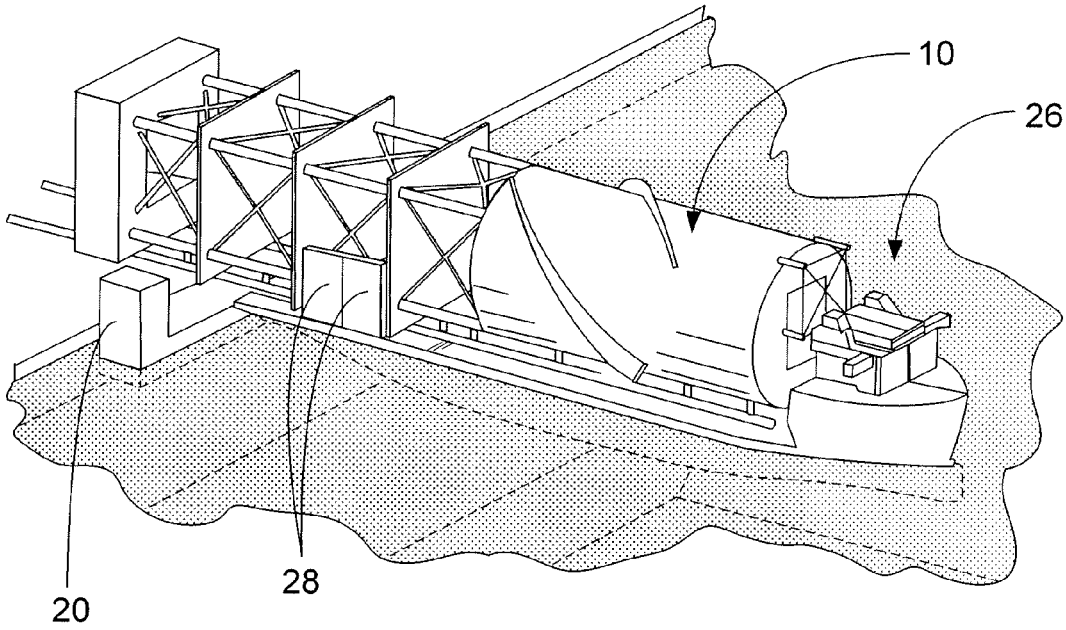
FIG. 5 is a perspective view of the spar, U-tank, and HLV at the completion of load out with the U-tank in a position further aft.

As seen in FIG. 5, both stability columns 28 of the HLV 26 have been placed on one side of the HLV 26. The U-tank 20 may be located further aft, as shown here, depending on the results of detailed analyses for a particular spar and HLV.

Figure 6:
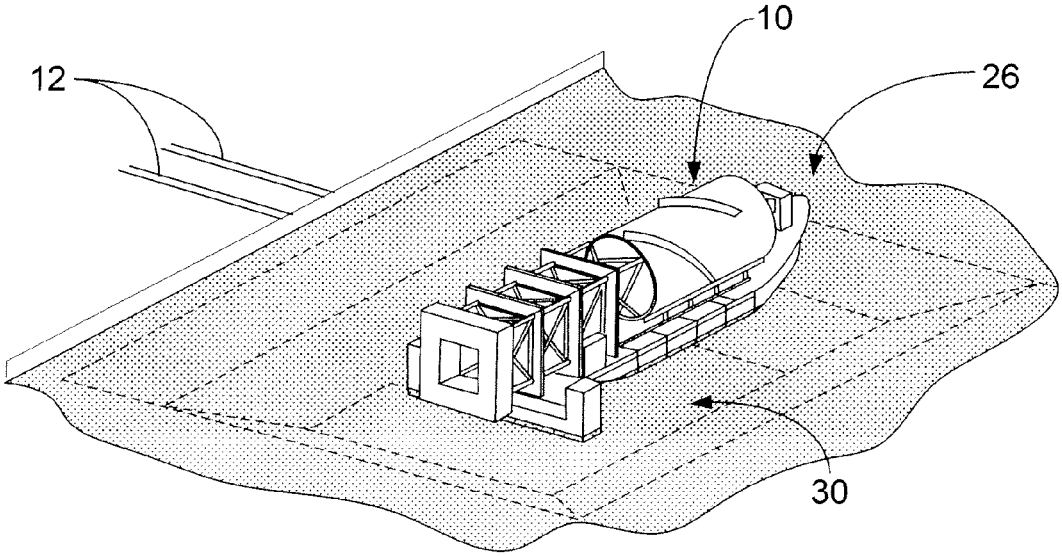
FIG. 6 is a perspective view of the spar, U-tank, and HLV assembly positioned over a dredged pit at the float off site.

As seen in FIG. 6, the U-tank 20, spar 10, and HLV 26 have been located over a dredged pit 30 at the float off site.

Figure 7:
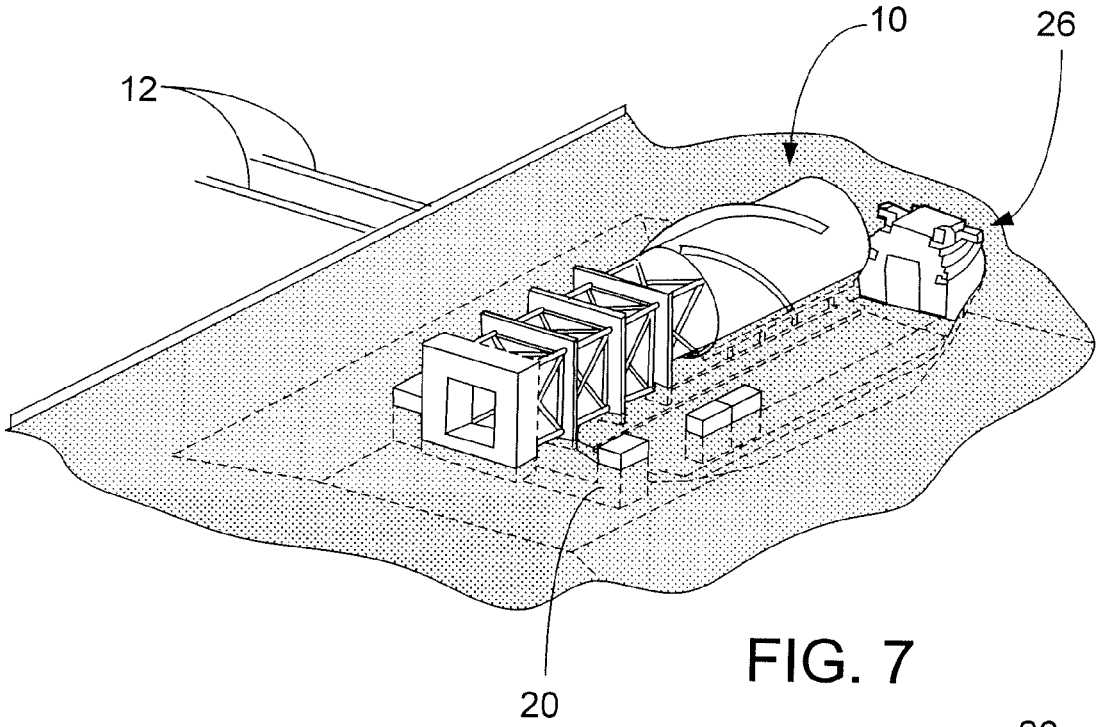
FIG. 7 is a perspective view of the spar and U-tank assembly floated off the HLV.

As seen in FIG. 7, the HLV 26 has been ballasted downward until the spar 10 and U-tank 20 have floated free of the HLV 26. The HLV 26 is shown part way through the lateral separation. During ballasting the U-tank 20 supplies the supplementary water plane area that keeps the assembly stable as the deck of the HLV 26 goes awash. Once the spar 10 floats free, the HLV 26 and spar 10 are separated laterally.

Figure 8:
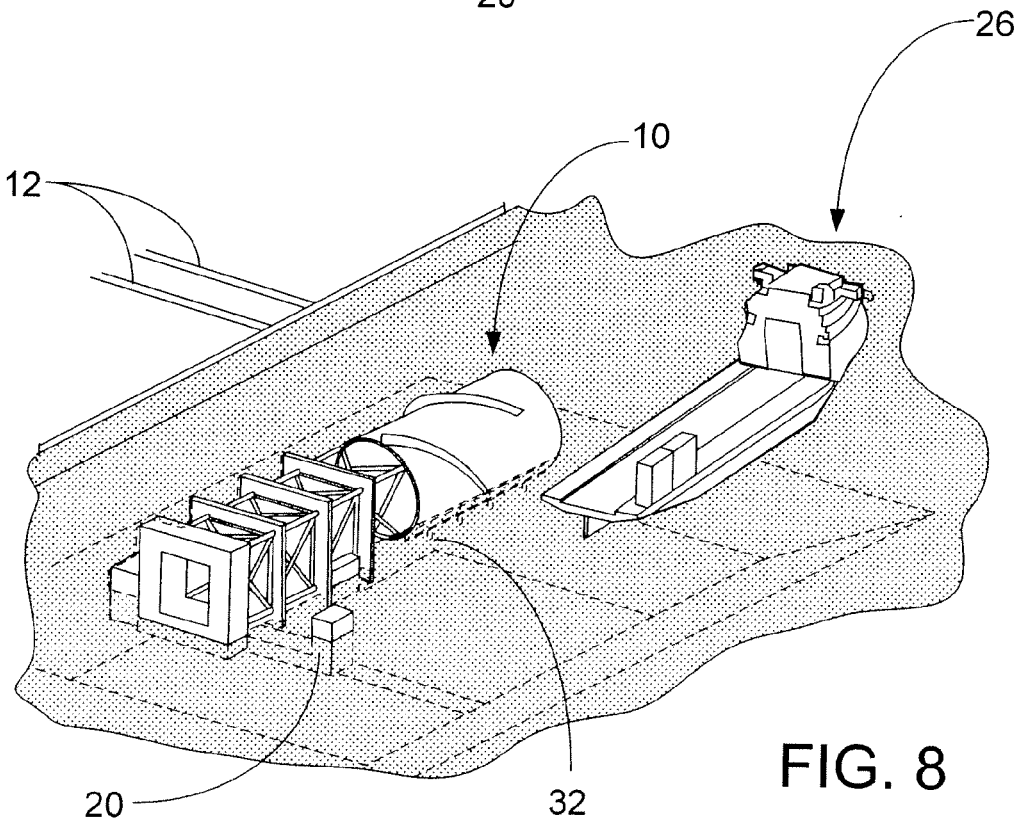
FIG. 8 is a perspective view of the spar and U-tank over the dredged pit with the HLV ballasted up and under way.

As seen in FIG. 8, the HLV 26 has been ballasted up and is departing. The cradle 32 is a complicated structure, but is represented here by stubs on the bottom side of the hard tank for ease of illustration purposes. The cradle 32 provides a small buoyant force against the spar 10 that keeps the cradle 32 in place.

Figure 9:
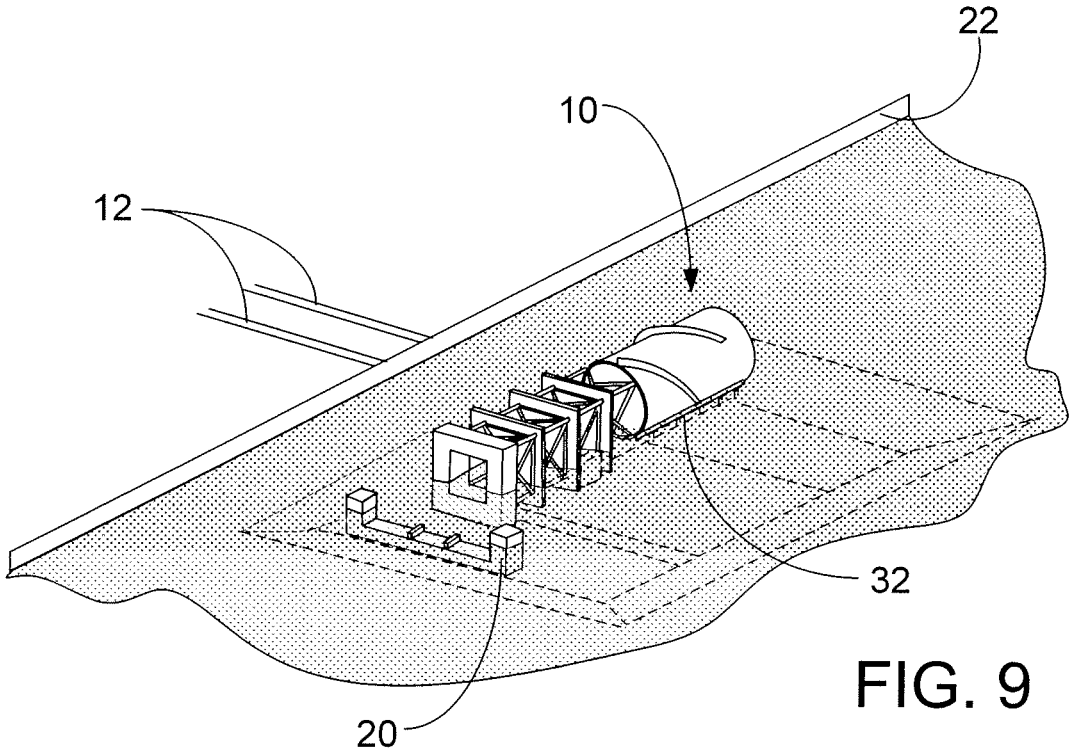
FIG. 9 is a perspective view of the spar over the deep pit.

As seen in FIG. 9, the U-tank 20 has been ballasted downward relative to the spar 10 and has been separated longitudinally from the spar 10. Before the separation of the spar 10 and the U-tank 20 the spar 10 is ballasted downward to provide sufficient stability to prevent unexpected rolling of the spar 10.

Figure 10:
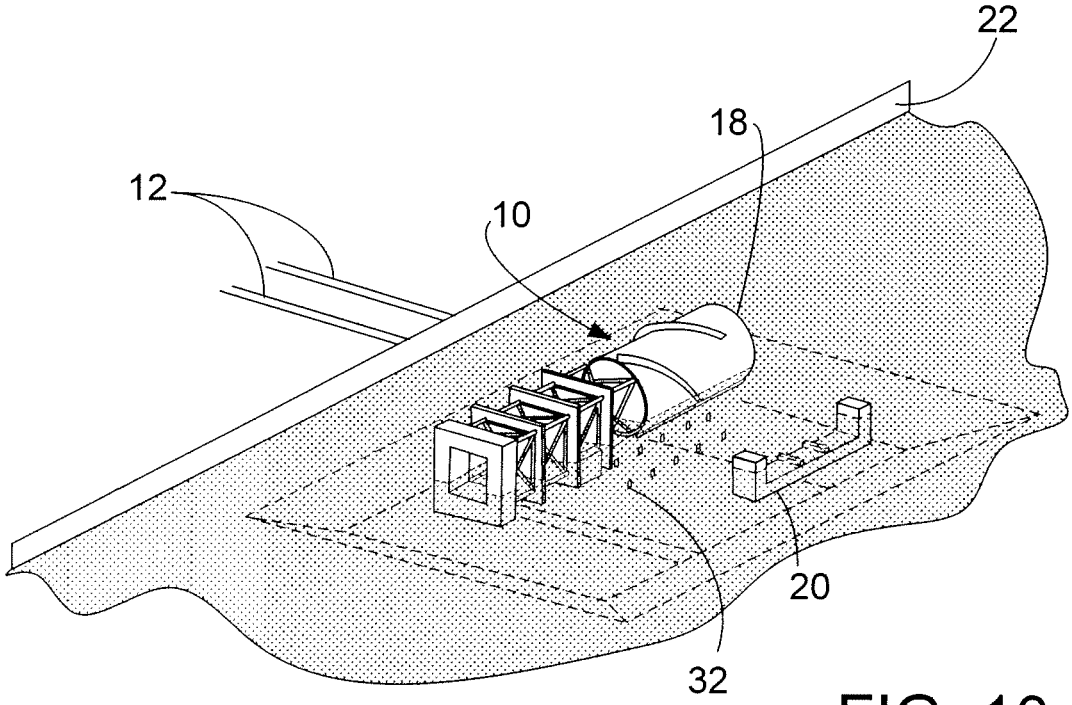
FIG. 10 is a perspective view of the spar over the deep pit with the U-tank on its way to the top of the hard tank.

As seen in FIG. 10, the U-tank 20 is about half way through its relocation to the top of the hard tank 18. The cradle 32 has been detached from the spar 10, flooded, and sunk to the bottom of the dredged pit 30. The cradle 32 is represented by an array of stubs. Subsequently, the cradle 32 will be ballasted up and recovered.

Figure 11:
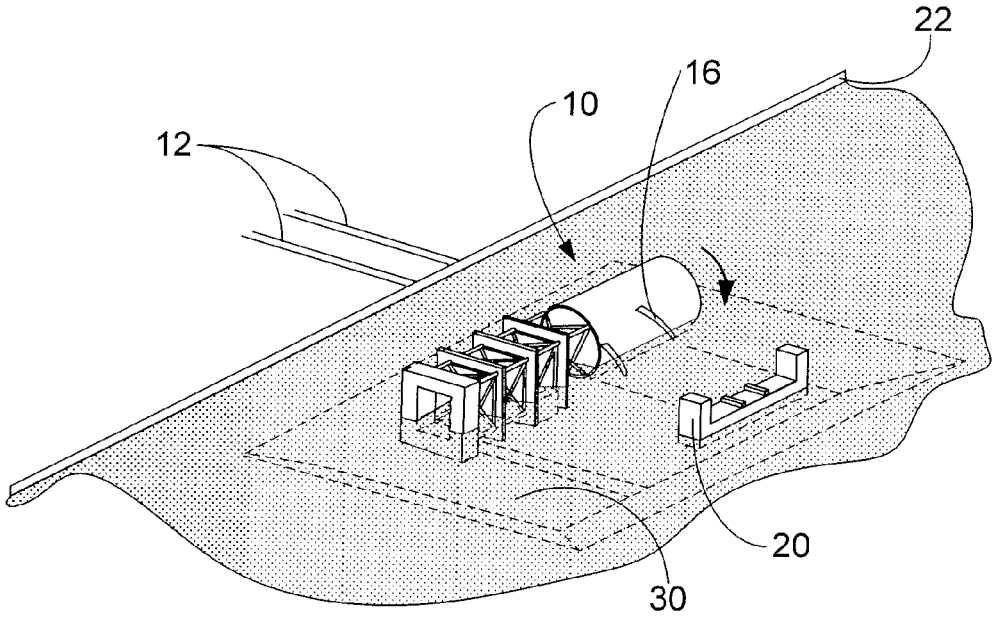
FIG. 11 is a perspective view of the spar over the deep pit with the U-tank on its way to the top end of the hard tank.

As seen in FIG. 11, the spar 10 has been rolled by sequential ballasting to place the portion of the hard tank 18 with incomplete strakes out of the water on the top side. Since the previously completed strakes 16 are now on the bottom side, this operation must be done in the water over the dredged pit 30 to provide sufficient strake tip bottom clearance.

Figure 12:
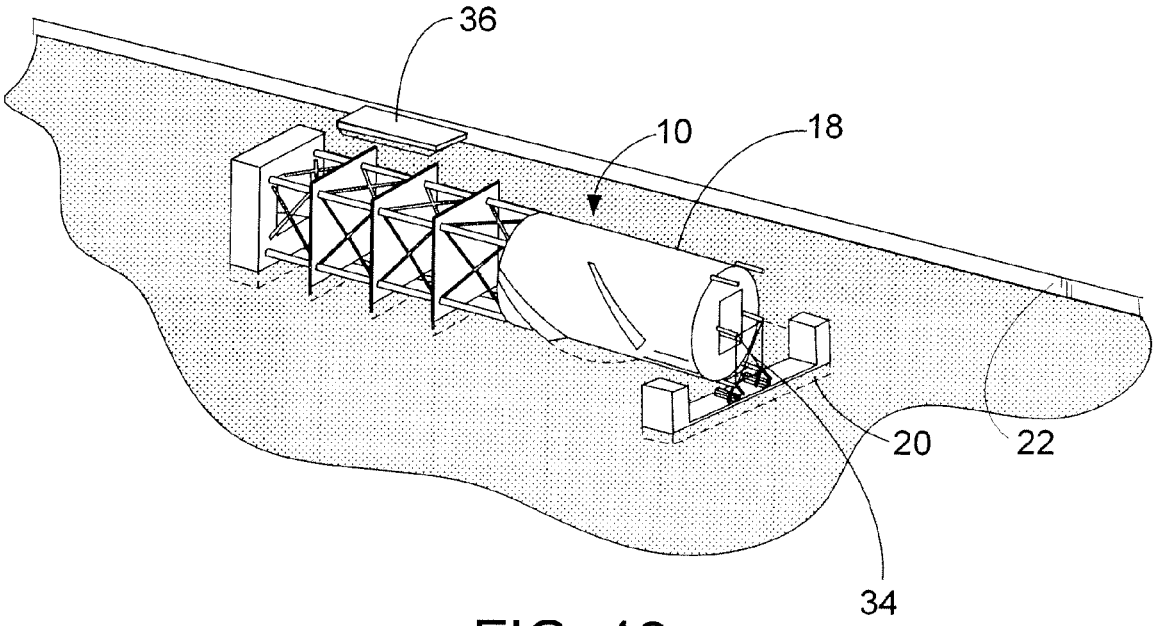
FIG. 12 is a perspective view of the spar over the deep pit with the U-tank placed beneath the frame cantilevered off the top of the hard tank.

As seen in FIG. 12, the U-tank 20 has been placed under a frame 34 cantilevered off the top end of the hard tank 18. The U-tank 20 is then ballasted upward to lift the spar 10 and reduce the draft of the spar 10. A spacer barge 36 is shown in the back ground alongside the quay 22. It should be understood that this is only one possibility for supporting the hard tank 18 on the U-tank 20 and that other variations of the frame 34 may be used. One example is the frame 34 being initially attached to the U-shaped tank 20 before engagement with the hard tank 18.

Figure 13:
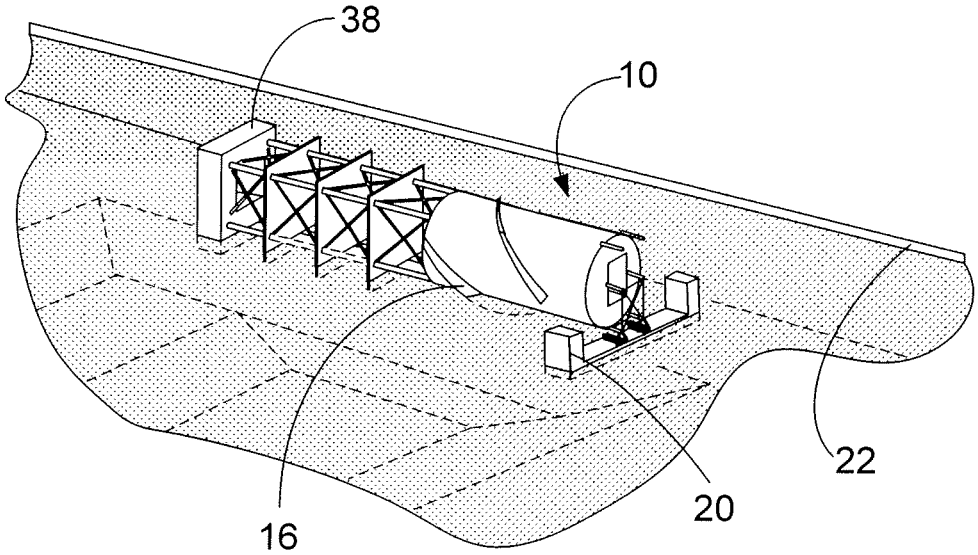
FIG. 13 is a perspective view of the spar alongside the quay.

As seen in FIG. 13, the spar 10 with its reduced draft is moved alongside the quay 22. The spar soft tank 38 is moored against the spacer barge 36 at one end and the U-tank 20 is moored against the quay 22 at the top end of the spar 10. In this position the incomplete strakes and any other work are completed and the spar 10 is made ready to depart.

Figure 14:
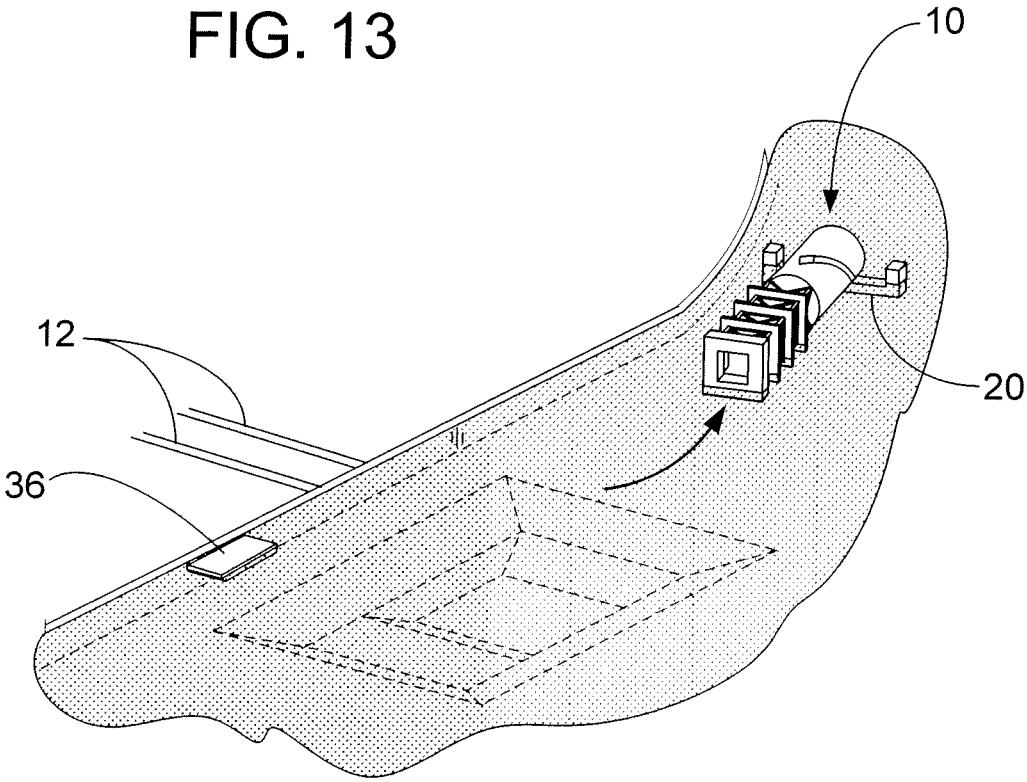
FIG. 14 is a perspective view of the spar underway, headed down the channel to the open sea.

As seen in FIG. 14, the spar 10 is then towed down the channel to the open sea. The lift of the U-tank 20 is required for the channel tow to reduce the draft of the spar 10, which results in sufficient strake tip bottom clearance.

After the channel tow the U-tank 20 is separated from the spar 10 in a good weather operation at a near shore location.

First, the spar 10 is ballasted for the wet tow to the installation site and then the U-tank is ballasted down until the spar 10 floats free. The U-tank 20 is separated longitudinally from the spar 10 and towed back to the fabrication site.

It should be understood that the method may also be accomplished by separating the U-tank 20 from the spar 10 and the HLV 26 at the initial load out site of the spar 10, once the spar 10 has been loaded onto the HLV 26. The HLV 26 may then be used to transport the spar 10 to a different, desired site for separation from the HLV 26 and further work on the strakes 16. Once at the new site, the U-tank 20 is reattached to the spar 10 and HLV 26 and the operation is carried out as described above.

In the configuration and operational sequence illustrated, the U-tank enhances the lifting capacity and stability of existing HLV's so that they can be used to load out and float off large diameter spars fabricated in one piece. The same U-tank is used to lift the spar after it is floated off the HLV to reduce its draft so that the channel tow to open sea can be made.

The major advantage offered by the inventive method of using the U-shaped tank is that the larger spar structures can be loaded out and floated off using one of several existing HLV's. Then the same U-shaped tank is used to reduce the draft of the spar so that the strakes can be completed and the channel tow to open sea made with completed strakes. Thus, the inventive method provides a capability which did not previously exist.

While the drawings and description are designed to illustrate the load out of a spar structure, it should be understood that the method described and illustrated is also applicable to any type of heavy or large structure, such as a deck for an offshore structure, that is skidded out from the fabrication yard, as opposed to being lifted out by a crane. The main difference from the description for the spar structure is that other structures may not require rotation once in the water or may not require being placed in the water prior to transportation. For installation on a base structure, such as a jacket, spar, or TLP, such other structures may be lifted from the HLV or they may be set in-place using a float over method known in the industry.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A method for load out of a spar type structure, comprising the steps:

a. positioning a spar structure on land perpendicular to a quay, the spar having first and second ends and strakes installed around a portion of the spar;

b. mooring a floating U-shaped tank alongside the quay and aligned with the spar;

c. mooring a heavy lift vessel against the U-shaped tank;

d. moving the spar onto the U-shaped tank and heavy lift vessel such that the U-shaped tank supports the first end of the spar and the heavy lift vessel supports the remainder of the spar, e. moving the heavy lift vessel, U-shaped tank, and spar over water having sufficient depth to allow float off of the spar;

f. ballasting the heavy lift vessel and U-shaped tank downward, causing float off of the spar;

g. separating the U-shaped tank from the spar and moving the heavy lift vessel and U-shaped tank from under the spar;

h. rotating the floating spar 180 degrees around its central axis by sequential ballasting;

i. attaching the U-shaped tank to the second end of the spar and ballasting the U-shaped tank upward to reduce the draft of the spar; and j. completing the strakes around the spar.

2. The method of claim 1, further comprising, during step d, preventing structural overload of the heavy lift vessel and stabilizing the spar by ballasting the heavy lift vessel and U-shaped tank.

3. The method of claim 1, further comprising installing a stability column on the heavy lift vessel after step d.

4. The method of claim 1, further comprising ballasting the spar downward before the U-shaped tank is separated from the spar.

5. A method for load out of a spar type structure, comprising the steps:

a. positioning a spar structure on land perpendicular to a quay, the spar having first and second ends and strakes installed around a portion of the spar;

b. mooring a floating U-shaped tank alongside the quay and aligned with the spar;

c. mooring a heavy lift vessel against the U-shaped tank;

d. ballasting the heavy lift vessel and U-shaped tank while moving the spar onto the U-shaped tank and heavy lift vessel such that the U-shaped tank supports the first end of the spar and the heavy lift vessel supports the remainder of the spar, e. installing a stability column on the heavy lift vessel;

f. moving the heavy lift vessel, U-shaped tank, and spar over water having sufficient depth to allow float off of the spar;

g. ballasting the heavy lift vessel and U-shaped tank downward, causing float off of the spar;

h. separating the U-shaped tank from the spar and moving the heavy lift vessel and U-shaped tank from under the spar;

i. rotating the floating spar 180 degrees around its central axis by sequential ballasting;

j. attaching the U-shaped tank to the second end of the spar and ballasting the U-shaped tank upward to reduce the draft of the spar; and k. completing the strakes around the spar.

6. The method of claim 5, further comprising ballasting the spar downward before the U-shaped tank is separated form the spar.

7. A method for load out of a spar type structure, comprising the steps:

a. positioning a spar structure on land perpendicular to a quay, the spar having first and second ends and strakes installed around a portion of the spar, b. mooring a floating U-shaped tank alongside the quay and aligned with the spar, c. mooring a heavy lift vessel against the U-shaped tank;

d. moving the spar onto the U-shaped tank and heavy lift vessel such that the U-shaped tank supports the first end of the spar and the heavy lift vessel supports the remainder of the spar, e. moving the heavy lift vessel, U-shaped tank, and spar over water having sufficient depth to allow separation of the U-shaped tank from the heavy lift vessel;

f. separating the U-shaped tank from the heavy lift vessel;

g. transporting the spar on the heavy lift vessel and the U-shaped tank separately to a desired site;

h. placing the U-shaped tank beneath the spar and ballasting upward to make contact with the spar;

i. ballasting the heavy lift vessel and U-shaped tank downward, causing float off of the spar;

j. separating the U-shaped tank from the spar and moving the heavy lift vessel and U-shaped tank from under the spar;

k. rotating the floating spar 180 degrees around its central axis by sequential ballasting;

l. attaching the U-shaped tank to the second end of the spar and ballasting the U-shaped tank upward to reduce the draft of the spar; and m. completing the strakes around the spar.

8. A method for load out of an offshore structure from a fabrication yard, comprising the steps:

a. positioning the structure on land perpendicular to a quay, the structure having first and second ends;

b. mooring a floating U-shaped tank alongside the quay and aligned with the structure;

c. mooring a heavy lift vessel against the U-shaped tank;

d. moving the structure onto the heavy lift vessel such that the U-shaped tank supports a portion of the of the structure during its movement onto the heavy lift vessel while the heavy lift vessel remains in contact with the U-shaped tank, the structure being moved entirely onto the heavy lift vessel and not resting on the U-shaped tank;

e. ballasting the heavy lift vessel and U-shaped tank during movement of the structure thereon;

f. separating the U-shaped tank from the heavy lift vessel and spar; and g. transporting the structure on the heavy lift vessel to a desired site.

* * * * *